United States Patent [19]

Welsch

[11] 4,299,333

[45] Nov. 10, 1981

[54] DISPENSER FOR CIGARETTE LIGHTERS

[76] Inventor: Thomas E. Welsch, 2216 Maple La., North Saint Paul, Minn. 55109

[21] Appl. No.: 32,863

[22] Filed: Apr. 24, 1979

[51] Int. Cl.[3] ..... G07F 11/20

[52] U.S. Cl. ..... 221/1; 221/197; 221/247; 221/251

[58] Field of Search ..... 221/197, 198, 228, 232, 221/241, 242, 247, 248, 251, 1; 194/93

[56] References Cited

U.S. PATENT DOCUMENTS

| | | | |
|---|---|---|---|
| 2,272,682 | 2/1942 | Srodulski | 221/242 X |
| 2,866,578 | 12/1958 | Fazekas | 221/251 X |
| 2,884,110 | 4/1959 | Krasney | 221/197 X |
| 3,023,873 | 3/1962 | Horton | 194/93 X |
| 3,578,207 | 5/1971 | Danow | 221/247 X |

*Primary Examiner*—F. J. Bartuska

*Attorney, Agent, or Firm*—Merchant, Gould, Smith, Edell, Welter & Schmidt

[57] ABSTRACT

A dispenser 2 for dispensing disposable cigarette lighters 3. Dispenser 2 includes a housing 4 which receives a cartridge 30 for holding the lighters 3 in a vertical column. Cartridge 30 includes a discharge opening 42 normally closed by a spring biased gate 66. A pusher 90 has a horizontal surface 92 which is interposed between the lowermost lighter 3' and the remaining lighters 3 in the cartridge 30. This horizontal surface 92 both elevates the column to remove the weight of the column from the lowermost lighter 3' and uses the front edge 96 thereof to open the gate 66 before the lowermost lighter 3' is dispensed. A plurality of cartridges 30 for different types of lighters and a plurality of different types of pushers 90 may be interchangeably used in dispenser 2.

4 Claims, 5 Drawing Figures

DISPENSER FOR CIGARETTE LIGHTERS

TECHNICAL FIELD

This invention relates generally to the coin operated vending machine industry. More particularly, this invention relates to a coin operated dispenser or vending machine for dispensing disposable plastic cigarette lighters.

DESCRIPTION OF THE PRIOR ART

Vending machines are widely known for dispensing many diverse products. One advantage of vending machines is that they do not require the presence of an operator to vend the product therefrom. Instead, the purchaser need only insert the required amount of money into the machine and operate the dispensing mechanism to obtain a desired product from the machine. The owner of the vending machine only has to periodically refill the machine and empty the coin changing mechanism.

Vending machines are known which dispense cigarette packages. These machines also usually dispense a book of matches each time that a cigarette package is purchased and dispensed. However, many smokers prefer to use cigarette lighters, rather than matches, to light their cigarettes. Cigarette lighters are usually cylindrical or tubular and contain a source of lighter fluid and an appropriate lighting mechanism for igniting the fluid to generate a flame.

Historically, cigarette lighters have been manufactured in a relatively permanent form in which the lighter fluid inside the lighter is periodically replaced upon its depletion. However, a recent innovation in this industry is that such lighters have been manufactured out of plastic to be disposable after the original supply of lighter fluid is consumed. Such disposable plastic lighters have become quite popular and are relatively low priced.

To the best of Applicant's knowledge, no vending machine has been specifically designed to vend disposable plastic lighters either by themselves or when one purchases a package of cigarettes. Such lighters present special problems in relation to their proper vending. For example, these lighters are often manufactured in different styles and sizes. One well known lighter is manufactured in an oval form while other lighters of this type have been manufactured as partially oval with flat, parallel ends or in a solely rectangular form. The width of different brands of lighters also varies widely. Furthermore, since the lighters are manufactured of plastic, some care must be taken during the dispensing thereof to avoid applying too much pressure or force to the lighter. Such pressure might crack or fracture the lighter casing. While various vending machines are known for dispensing various products, none of the machines of which Applicant is aware would be suited for dispensing disposable plastic lighters.

SUMMARY OF THE INVENTION

This invention relates generally to a dispenser for vending or dispensing disposable plastic cigarette lighters.

The dispenser of this invention includes a housing in which a vertically elongated magazine is received. The magazine contains a vertical column of cigarette lighters therein and a discharge opening at its lower end through which the lowermost lighter will be dispensed.

A gate is contained inside the housing to close the discharge opening and the gate is biased into its closed position. The dispenser includes a dispensing means comprising a pusher which is shaped to open the gate before the lowermost element is pushed therethrough. In addition, the pusher also includes means for elevating the remaining lighters in the column to remove the weight of the column from the lowermost lighter being dispensed. Preferably, the magazine will be formed as a removable cartridge for easy replacement in the housing. A plurality of differently sized cartridges will be used with each cartridge being designed to accept one particular type or style of lighter.

This invention also involves a novel method of dispensing a cigarette lighter from a vertical column thereof. This method involves elevating the lighters in the column above the lowermost lighter to remove the weight of the column from the lowermost lighter. After the elevating step, a gate which normally retains the lowermost lighter in the column is opened, and the lowermost lighter is then pushed through the gate to dispense the same from the column.

BRIEF DESCRIPTION OF THE DRAWINGS

This invention will be described in detail hereafter in the Detailed Description, when taken in conjunction with the following drawings, in which like reference numerals will refer to like elements throughout.

DETAILED DESCRIPTION

Figure 1:
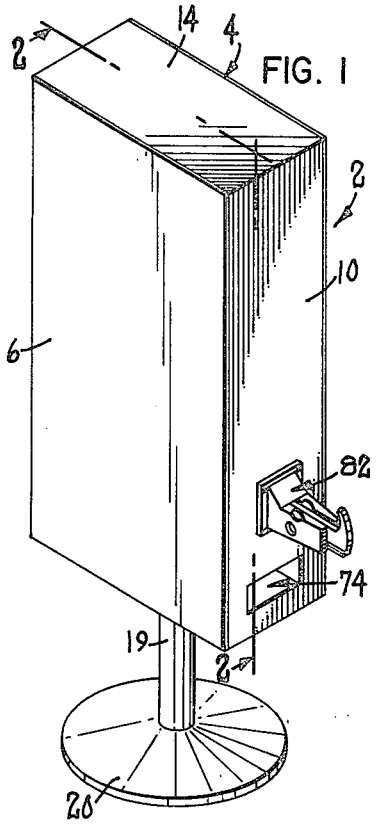
FIG. 1 is a perspective view of an improved dispenser according to this invention particularly illustrating the exterior configuration of the dispenser.

Referring first to FIG. 1, an improved dispenser or vending machine according to this invention is generally illustrated as 2. Dispenser 2 is particularly designed for dispensing disposable plastic cigarette lighters 3. Such lighters 3 are made by different manufacturers and have different cross-sectional configurations as well as different widths. For example, a lighter having a generally oval cross-sectional configuration is commercially available. See FIGS. 2 and 3. Other lighters are manufactured in which the cross-sectional configurations are not completely oval, but are either rectangular or have at least two parallel, flat sides. While dispenser 2 will be described for use primarily with regard to cigarette lighters 3, it may also be used to dispense any other product having a shape generally similar to a cigarette lighter, i,e. a cylindrical or tubular element which is generally elongated along a longitudinal axis.

Dispenser 2 includes a substantially rectangular, hollow housing 4. Housing 4 includes spaced front and rear walls 6 and 8, spaced side walls 10 and 12, and top and bottom walls 14 and 16 all fixedly connected together to form a rectangular box. Housing 4 is shaped to define an open interior cavity 18. Front wall 6 of housing 4 can be hinged along one of the side walls 10 or 12 to form a pivotable door. Front wall 6 can be swung open for the purpose of gaining access to the interior cavity 18 of housing 4. Suitable locks will be provided for locking front wall 6 in a closed position to prevent unauthorized access into the interior cavity 18. Preferably, housing 4 is located above ground level on an upright standard or pedestal 19 having an enlarged ground engaging base 20. The height of pedestal 19 is selected so that housing 4 is positioned above the ground at a convenient height for dispensing cigarette lighters therefrom. However, any type of support structure could be utilized for mounting housing 4 in an appropriate dispensing position.

Figure 4:
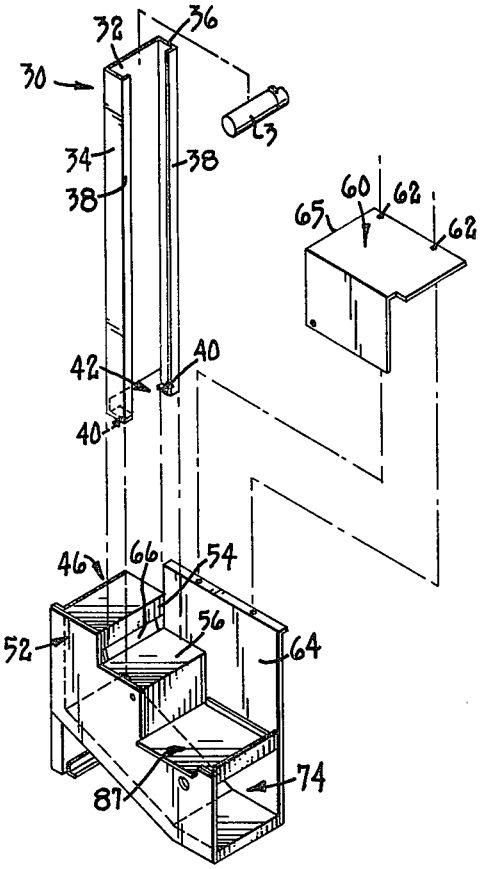
FIG. 4 is a perspective view shown in exploded form of a portion of the dispenser of FIG. 1, particularly illustrating a lighter receiving cartridge and a bottom support member for engaging the lower end of the cartridge to support that end of the cartridge inside the housing of the dispenser.

Referring now to FIG. 4, an elongated vertical magazine formed as a removable cartridge is generally indicated as 30. Cartridge 30 includes a front wall 32 having side walls 34 and 36 depending rearwardly therefrom. Side walls 34 and 36 are made sufficiently wide such that cartridge 30 has a width corresponding to the width of the particular type of lighter which is meant to be contained in cartridge 30. Both of the side walls 34 and 36 include inwardly turned flanges 38 which are parallel to front wall 32 to form, in effect, a rear wall of cartridge 30. In addition, side walls 34 and 36 have inwardly turned lateral tabs 40 located at the bottom end thereof.

Front wall 32 does not extend along the entire length of the side walls 34 and 36, but is spaced slightly above the bottom thereof to define a discharge opening 42. Discharge opening 42 has a height which is greater than the height of a single cigarette lighter 3, but less than the height of two cigarette lighters 3, so that one cigarette lighter 3 at a time can be dispensed through opening 42. A plurality of cigarette lighters 3 are contained in the cartridge 30 in a vertical column with the cartridge being loaded from the open top end of the cartridge. The lighters 3 are retained by the tabs 40 at the bottom thereof and by the inwardly turned flanges 38. Other than the open top end of cartridge 30, discharge opening 42 is the only means of egress for lighters 3 from the cartridge 30.

Cartridge 30 is removably contained in the interior cavity 18 of housing 4 by any suitable supporting means. One preferred supporting means comprises spaced top and bottom support members generally indicated respectively as 44 and 46. Top and bottom support members 44 and 46 each include a U-shaped slot 48 and 50. Slots 48 and 50 point towards one another to engage the opposed top and bottom ends of the cartridge 30 for holding the cartridge in place inside housing 4.

Top support member 44 includes two opposed L-shaped flanges 43 and 45 which are attached to the top wall 14 of housing 4. The vertical wall of flanges 43 and 45 define the opposed sides of slot 48 and abut against opposed sides of cartridge 30. Preferably, the rearmost flange 45 is adjustably secured, using screws or similar securing members, to the top wall 14 of housing 4. This adjustable feature allows the flange 45 to be moved towards or away from flange 43 to decrease or increase the size of slot 48.

Figure 3:
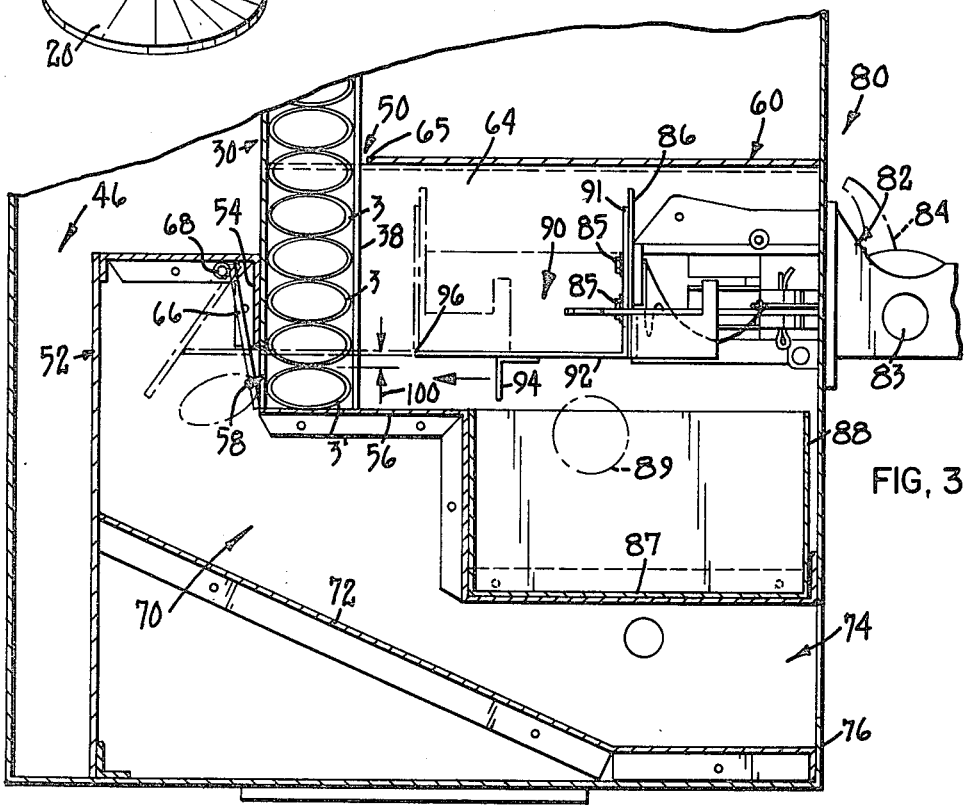
FIG. 3 is an enlarged cross-sectional view of the lower portion of the dispenser housing shown in FIG. 2, particularly illustrating the lower end of a lighter containing cartridge, the supporting means for supporting that end, and a pusher for dispensing the lowermost lighter from the cartridge.
Figure 5:
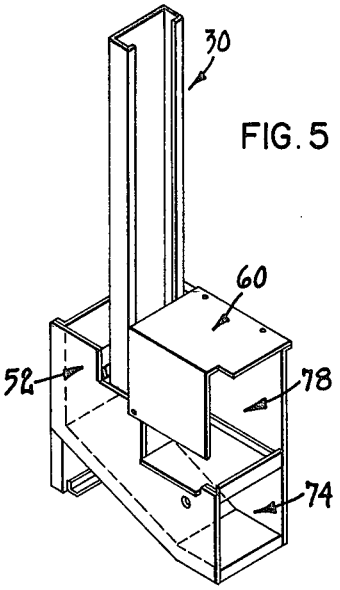
FIG. 5 is a perspective view of the components shown in FIG. 4, particularly illustrating those components in an assembled relationship.

Referring to FIGS. 3–5, bottom support member 46 is made in two parts. These parts include a first portion 52 suitably fixed to the bottom wall 16 of housing 4. First housing portion 52 includes a first, vertically extending front wall 54 and a horizontally extending bottom wall 56. Horizontal wall 56 defines a support surface for the lower end of cartridge 30. Vertical wall 54 includes an opening 58, generally of the same size as discharge opening 42 in cartridge 30, which is adapted to mate with discharge opening 42. As shown in FIG. 3, the front wall 32 of cartridge 30 abuts against vertical wall 54 when the cartridge is held inside the housing 4. The lower end of the cartridge rests on support surface 56.

An L-shaped bracket, generally indicated as 60, forms the second portion of the bottom support member 46. Bracket 60 has a plurality of mounting holes 62 therein, by which the bracket 60 may be removably connected to a second vertical wall 64 on the first portion 52. Any suitable screws or bolts may be used to extend through holes 62 to releasably secure bracket 60 to vertical wall 64. Wall 64 extends perpendicularly to both the first vertical wall 54 and support surface 56 such that the cartridge 30 can be laterally engaged against wall 64. The front wall 65 of bracket 60 is engaged against the opposed side of cartridge 30, i.e. against the flanges 38, to define one side of the U-shaped slot 50 in lower support member 46. Thus, the U-shaped slot 50 in lower support member 46 is defined by the front vertical wall 54 and the L-shaped bracket 60 which together pinch or clamp the lower end of cartridge 30 therebetween. See FIG. 5 which shows these components in an assembled relationship.

First portion 52 includes a spring biased gate generally indicated as 66. Gate 66 is pivotally mounted on an axis 68 and includes a torsion spring (this torsion spring forces the gate into a closed position as shown in solid lines in FIG. 3). Gate 66 in its closed position serves to block discharge opening 42 in cartridge 30. This retains the lowermost lighter 3 in the cartridge and prevents that lighter 3 from falling out through the discharge opening 42 in the event that the housing 4 is tilted or shook in an attempt to cheat dispenser 2.

A discharge passageway generally indicated as 70 is located beneath the gate 66. Discharge passage 70 includes a downwardly sloped ramp 72 that leads outwardly to an access opening 74 in the side wall 10 of housing 4. The purpose of discharge passageway 70 is to guide and direct a lighter 3 dispensed from cartridge 30 to the access opening 74. Access opening 74 includes a vertical flange 76 for retaining a dispensed lighter immediately adjacent the opening 74. See the phantom line illustration of the lighter in FIG. 2. In such a position, the purchaser of the lighter 3 can place his hand through access opening 74 to remove the lighter. One side of discharge passageway 70 is closed by a front cover plate 69 and the other side by the vertical wall 64. See FIG. 4.

The L-shaped bracket 60 defines a dowwnaardly opening, substantially enclosed tunnel generally indicated as 78 in FIG. 5 adjacent the rear side of cartridge 30. Housing 4 includes a dispensing means for vending or dispensing the lowermost lighter in cartridge 30 through discharge opening 42. This dispensing means is generally indicated as 80 in FIGS. 1–3. Preferably, dispensing means 80 includes any conventional coin operated dispensing mechanism indicated as 82. Dispensing mechanism 82 can be attached to side wall 10 of housing 4 immediately above access slot 74.

Dispensing mechanism 82 includes apertures 83 for receiving coins therein and a manually operable actuating slide 84 having an inner end 86 inside housing 4. When sufficient money has been deposited in the apertures 83, actuating slide 84 can be pushed inwardly over a full stroke of movement. The inner end 86 of slide 84 includes a pusher generally indicated as 90. Pusher 90 is coupled to the inner end 86 of slide 84 by means of two screws 85 which pass through a slot (not shown) in the vertical mounting wall 91 of pusher 90. Screws 85 and the slot in wall 91 provide a means for adjusting the height of pusher 90 in relation to slide 84. In any event, when slide 84 is actuated, pusher 90 moves from its solid line position in FIG. 3 to its phantom line position to dispense the lowermost lighter in cartridge 30.

First housing portion 52 also includes a recess, generally indicated as 87, located in support surface 56. Recess 87 is generally located beneath the tunnel 78 and dispensing mechanism 82. Recess 87 is suited for releasably holding a rectangular coin receipt box 88 having an open top end. The coins 89, which are received in dispensing mechanism 82, inside of housing 4 are deposited into the box 88. Box 88 may be periodically emptied and replaced simply by opening door 6 of housing 4.

Referring now to the operation of the dispenser 2, cartridge 30 is shown as being loaded with a plurality of oval cross section type disposable plastic lighters. These lighters 3 have an oval cross-sectional shape. A plurality of these lighters 3 are contained in cartridge 30 in a vertical column. Cartridge 30 is loaded between the top and bottom support members 44 and 46 when the door 6 of housing 4 is opened. A pusher 90, which is especially designed for vending oval shaped lighters, is then mounted on the end of slide 84.

The pusher 90 designed especially for oval lighters includes a first horizontal surface generally indicated as 92. Surface 92 extends forwardly from the vertical mounting wall 91 of pusher 90. A pusher surface depends downwardly from horizontal surface 92. Pusher surface 94 is located rearwardly of the front edge 96 of horizontal surface 92. Pusher surface 94 may be formed by an L-shaped flange suitably welded to the underside of horizontal surface 92.

Pusher 90 is mounted on the inner end 86 of slide 84 such that the horizontal support surface 92 is directed or pointed against the lower half of the second lighter in cartridge 30. When an appropriate amount of money is put into the dispensing mechanism 82, slide 84 can eventually be actuated over a full stroke to cause the pusher 90 to approach and enter cartridge 30. The front edge 96 of horizontal surface 92 first engages the second lighter below its center to become interposed between the lowermost lighter 3' and the remaining lighters 3 in cartridge 30. This interposition serves to elevate the remaining lighters 3 in the cartridge by a short distance which is designated as 100 in the figures. Thus, the pusher 90 first serves to elevate all of the lighters 3 in the cartridge above the lowermost lighter 3' to relieve the weight of the stack from the lowermost lighter 3'.

Pusher surface 94 is located on the horizontal surface 92 sufficiently far in back of the front edge 96 such that edge 96 engages the gate 66 before the pusher surface 94 engages the lowermost lighter 3'. Thus, the front edge 96 will open the gate 66 before the lowermost lighter 3' is dispensed through discharge opening 42. This is important when the lighters 3 are shaped ovally since an oval lighter pushed directly against the gate 66 would tend to rotate against the gate rather than pushing the gate open. Such unintended rotation of the lighter might cause the lighter to become jammed in opening 42. Thus, the particular arrangement of pusher 90 obviates this possible problem by always opening the gate 66 before pushing the lowermost lighter 3' therethrough. Once the lowermost lighter 3' is pushed through the discharge opening 42, it falls through the discharge passageway 70 until it arrives at the access slot 74. It can then be removed from the access slot 74 by the purchaser.

Figure 2:
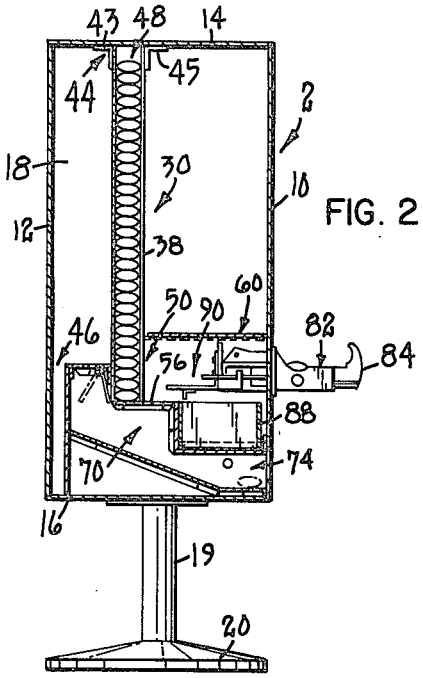
FIG. 2 is a partial cross-sectional view of the dispenser shown in FIG. 1, taken along lines 2—2 in FIG. 1.

The particular pusher 90 disclosed herein and shown in FIGS. 2 and 3 is advantageous in dispensing ovally shaped cigarette lighters, or in fact any oval element. This pusher both elevates the lighters 3 in the column as well as pre-opening the gate 66 at the discharge opening to facilitate the proper dispensing of the lowermost lighter 3'. By removing the stack weight from the lowermost lighter 3', less stress is subjected to the lighter 3' during the dispensing operation. By pre-opening the gate 66 at the discharge opening 42, the lighter 3' will not tend to rotate on the gate as it might if it were not pre-opened. Thus, the dispensing means 90 disclosed herein is particularly advantageous for ovally shaped lighters.

Dispenser 2 could be built such that cartridge 30 was fixedly contained inside the housing 4. In such a case, the cartridge or magazine would be filled simply by placing the lighters one by one into the open top end.

Preferably, a block or retaining member (not shown) which is larger than the lighters 3 and larger than discharge opening 42 is placed on the top of the last lighter in cartridge 30. This block serves as a weight to bias the stack of lighters downwardly. In addition, when the last lighter 3 in the cartridge has been dispensed, this block will fall in front of discharge opening 42. If a purchaser then attempts to purchase a lighter 3, the edge 96 of pusher 90 will engage the block and prevent the pusher 90 from extending through the discharge opening 42. In fact, this engagement with the pusher 90 will occur before the user's money has dropped down into the coin receipt box 88. Thus, the block prevents the vending of any additional lighters if the cartridge is empty.

Preferably, a plurality of different cartridges are kept on hand with each having the same general construction as the cartridge 30 but which have different widths to accept different sized lighters. Each of these different cartridges can be easily used in the dispenser 2 merely by adjusting the size of the U-shaped slots 48 and 50 at the top and bottom of housing 4. With regard to the top support member 44, the rearmost flange 45 is adjustable relative to the housing 4 in the same manner that the L-shaped bracket 60 is adjustable. In other words, the securing screws may be unloosened and the flange 45 or bracket 60 simply slid longitudinally a short distance on either housing 4 or vertical wall 64 to increase the width of the slot. The screws may then be reinserted and tightened.

While the same pusher member 90 would be effective in vending most shapes of lighters, it is not strictly necessary for lighters having other than oval shapes with completely rounded sides to have a pusher which serves to pre-open the gate 66. For example, many lighters will have a flat side located immediately adjacent the gate. In this instance, the pusher surface 94 of the pusher 90 could be located along, or slightly in back of, the edge 96 of the horizontal surface 92. This type of pusher would simply engage the rear side of the lighter 3' and push the lighter straight through the opening 42 with the front side of the lighter serving to engage and open the gate 66. Such an alternative pusher may be used whenever the lighter has a flat side immediately adjacent the gate.

Thus, the dispenser 2 of the present invention is also particularly advantageous in that it provides a readily adaptable mechanism for vending many different types of lighters including those with different cross-sectional shapes and widths. All that is required to convert the dispenser 2 from vending one type of lighter to another is to utilize a different cartridge 30 and possibly, but not necessarily, a different pusher 90. These changes can be quickly and easily made so that the same dispenser 2 can be used for dispensing different types of lighters or similarly shaped objects.

Various modifications of this invention will be apparent to those skilled in the art. Various components of dispenser 2 can be made of any suitable material and are preferably made of metallic material of suitable strength. Thus, the scope of this invention is to be limited only by the appended claims.

What is claimed is:

1. A dispenser for use in dispensing cigarette lighters having different widths and cross-sectional shapes, which comprises: a substantially enclosed housing having a selectively openable door for allowing access to the interior of the housing; a plurality of cartridges each of which is configured to receive a plurality of lighters of different types with the cartridges suited to be interchangeably received in the interior of the housing, wherein each cartridge has a discharge opening adjacent one end which is sized to allow one lighter to pass therethrough; means for supporting a selected one of the cartridges inside the housing in a vertical orientation with the lighters held in the cartridge being stacked one on top of the other with the discharge opening being located at the lower end of the cartridge, wherein the supporting means includes a spring biased gate located against the discharge opening for normally preventing movement of the lowermost lighter through the opening; and means for dispensing the lowermost lighter in the cartridge through the discharge opening, the dispensing means including a selectively operable pusher which enters into the cartridge to push the lowermost lighter through the discharge opening and past the gate to dispense the same from the housing, wherein the pusher comprises:

(a) a first substantially horizontal surface which is adapted to be interposed between the lowermost lighter and the remaining lighters in the column thereof, wherein the horizontal surface is positioned relative to the column of lighters to elevate the remaining lighters in the column as it is interposed into the column; and (b) a pushing surface which depends generally downwardly from the horizontal surface for engaging and pushing the lowermost lighter through the discharge opening of the cartridge, and wherein the pushing surface is located in back of the front edge of the horizontal surface such that the front edge opens the gate before the pushing surface dispenses the lowermost lighter therethrough; whereby the lighter does not engage against the gate during its dispensing movement, and wherein the weight of the column of lighters in the cartridge is supported by the pusher as the lowermost lighter is being dispensed.

2. A dispenser for use in dispensing a plurality of oval elongated elements one by one, which comprises:

(a) a substantially enclosed housing;

(b) a vertically elongated magazine carried in the housing for receiving a vertical column of oval elements therein, wherein the magazine has a discharge opening at its lower end through which the lowermost element in the column will be dipsensed;

(c) a gate contained inside the housing for closing the discharge opening in the magazine to retain the lowermost element therein, wherein the gate is biased into its position for closing the discharge opening; and (d) means for dispensing the lowermost element from the magazine, wherein the dispensing means includes a pusher which is shaped to open the gate before the lowermost element is pushed out of the magazine, wherein the pusher includes means for elevating and supporting the column of the lighters above the lowermost lighter before the lowermost lighter is engaged by the pusher in order to be dispensed.

3. A dispenser as recited in claim 2, wherein the pusher comprises:

(a) a first substantially horizontal surface which is adpated to be interposed between the lowermost lighter and the remaining lighters in the column thereof, wherein the horizontal surface is positioned relative to the column of lighters to elevate the remaining lighters in the column as it is interposed into the column; and (b) a pushing surface which depends generally downwardly from the horizontal surface for engaging and pushing the lowermost lighter through the discharge opening of the cartridge, and wherein the pushing surface is located in back of the front edge of the horizontal surface such that the front edge opens the gate before the pushing surface dispenses the lowermost lighter therethrough.

4. A method for dispensing a plurality of oval elongated cigarette lighters, which comprises the steps of:

(a) arranging the lighters in a vertical column inside a magazine having a discharge opening at the bottom;

(b) normally closing the discharge opening with a gate to retain the lowermost lighter in the column;

(c) elevating and supporting all of the lighters in the column above the lowermost lighter before the lowermost lighter is engaged by a dispensing pusher;

(d) dispensing the lowermost lighter from the column by first opening the gate and then pushing the lowermost lighter through the discharge opening; and (e) repeating step (d) until all of the lighters in the column have been dispensed.

* * * * *